US005832557A

United States Patent [19]

Hutchison

[11] Patent Number: 5,832,557

[45] Date of Patent: Nov. 10, 1998

[54] PAINT ROLLER REMOVER TOOL

[76] Inventor: Vincent Hutchison, 1908 Venning Cir., Guntersville, Ala. 35976

[21] Appl. No.: 857,694

[22] Filed: May 16, 1997

[51] Int. Cl.[6] ..... B05C 17/02; B05C 21/00

[52] U.S. Cl. ..... 15/230.11; 15/236.03; 15/236.07

[58] Field of Search ..... 15/230.11, 236.03, 15/236.07; 29/244, 267, 895.1

[56] References Cited

U.S. PATENT DOCUMENTS

| | | | |
|---|---|---|---|
| 2,944,275 | 7/1960 | Markusen | 15/236.01 |
| 2,961,683 | 11/1960 | Meyer . | |
| 3,707,740 | 1/1973 | Demers | 15/236.03 |
| 4,287,631 | 9/1981 | Marrs . | |
| 4,667,361 | 5/1987 | Wolcott et al. . | |
| 4,985,974 | 1/1991 | Fivecoate . | |
| 5,283,923 | 2/1994 | Schaedel . | |
| 5,440,776 | 8/1995 | Kartler | 15/237.07 |

*Primary Examiner*—Terrence Till
*Attorney, Agent, or Firm*—John C. Garvin, Jr.

[57] ABSTRACT

A tool for removing used, paint soaked, rollers from roller frame assemblies without the user's hands having to touch the paint soaked roller. The tool includes a handle, an enlarged C-shaped head having a semicylindrical inner surface, and a member secured to the semicylindrical inner surface of the enlarged C-shaped head for engaging one end of the paint soaked roller. The tool allows a user to hold the roller frame assembly in one hand and the tool in the other hand to push the paint soaked roller from the roller frame assembly without getting paint on the hands of the user during the removal process.

10 Claims, 1 Drawing Sheet

PAINT ROLLER REMOVER TOOL

TECHNICAL FIELD OF THE INVENTION

The present invention relates to the general art of hand tools for use with painting equipment, and more particularly to a tool for easily and efficiently removing a used, paint soaked, roller from the roller frame assembly.

BACKGROUND OF THE INVENTION

A paint roller apparatus is an efficient and convenient means for applying paint to a surface, particularly a flat surface. A paint roller apparatus generally includes a roller frame assembly having a handle at one end and a cage at the other end; and a roller cover or roller having a nap made of polyester, lambswool or other well known material which is releasably mounted over the cage. When using a paint roller apparatus, paint is normally held in a paint roller pan. The roller cover or roller, mounted on the cage of the roller frame assembly, is dipped and rolled in the paint roller pan to secure paint on the exterior of the roller. The roller is then rolled over a surface to transfer paint from the roller to the surface. The process is continuously repeated until the entire surface or area has a coat of paint thereon.

This nearly universal system of having the roller cover or roller separate from the roller frame assembly has evolved because it is easier to clean and dry the roller when the roller is separate from the frame assembly, and changing colors and textures is expedited when one can simply remove the used roller and replace it with a clean, dry, roller. The main drawback with the conventional paint roller apparatus is that while it is a simple process to slide a clean, dry, roller onto the frame assembly, the reverse process of removing a slippery, paint soaked, roller from the frame assembly can be, and very often is, an extremely messy affair. If a person's hands are used to get a grip on the paint soaked roller, the hands get covered with paint. Disposable gloves are often used to keep the paint off the hands, but they can prevent the person getting a good grip on the roller and create problems in removing the roller from the frame assembly.

Several devices have been previously disclosed for removing a used, paint soaked, roller from a frame assembly. The devices disclosed in the following U.S. patents are exemplary of such prior art devices: U.S. Pat. No. 2,961,683 to Meyer; U.S. Pat. No. 4,667,361 to Wolcott et al.; U.S. Pat. No. 4,985,974 to Fivecoate; and U.S. Pat. No. 5,283,983 to Schaedel.

U.S. Pat. No. 2,961,683 to Meyer discloses complex paint roller tongs for removing the roller from the roller frame assembly, extracting excess paint from the roller, and holding the roller during the cleaning process to prevent a person's hands from coming into direct contact with the paint soaked roller. U.S. Pat. No. 4,667,361 to Wolcott et al. discloses a combination device for scraping excess paint from the nap of a paint soaked roller and for providing a hand grip by which a used paint roller can be slid off the cage of a roller frame assembly. U.S. Pat. No. 4,985,974 to Fivecoate discloses a device including a piston which engages a roller frame assembly to move the roller frame assembly with respect to the paint soaked roller when a trigger is actuated without requiring the user to touch the paint soaked roller. U.S. Pat. No. 5,283,923 to Schaedel discloses a relatively complex tool for removing a paint saturated roller from a roller frame assembly through use of a plunger for engaging the roller frame assembly for pushing the roller frame assembly to disengage the roller frame assembly from the roller which is retained within the tool, which tool may also have use in conjunction with a cartridge containing caulking, sealant, glue and the like.

Accordingly, there exists a need for an effective tool for a user to remove paint soaked rollers from roller frame assemblies without the user's hands touching the wet paint roller. The present invention meets this need by providing a simple, inexpensive, hand held, tool that will not wear out and is capable of repeated uses for many years. A major advantage of my invention resides in the fact that the user merely holds onto the handle of the roller frame assembly with one hand, and holds the handle of the tool with the other hand, and engages one end of the roller with the tool to allow the user to push the paint soaked roller off of the cage of the roller frame assembly.

SUMMARY OF THE INVENTION

In accordance with the present invention, a tool is provided for removing used, paint soaked, rollers from roller frame assemblies without the user's hands having to touch the paint roller. The tool is integral and has a handle at one end and roller engaging means at its other end, which roller engaging means is adapted to engage either the nap of the roller or its core to allow the easy removal of the used roller from its roller frame assembly. The tool allows a user to hold the roller frame assembly with one hand and the tool in his other hand to push the paint soaked roller from the roller frame assembly without paint getting on the user's hands during the removal process. The roller can then be cleaned, for reuse, in the conventional manners.

Accordingly, it is an object of the present invention to provide a tool for removing used, paint soaked, rollers from roller frame assemblies without paint getting on the user's hands, which tool is made of readily available, inexpensive, materials.

A further object of the present invention is to provide a tool for easily removing used, paint soaked, rollers from roller frame assemblies, which tool is simple in construction and made of readily available, inexpensive, materials, and permits the removal of the rollers from the frame assemblies without the user having to touch the paint soaked roller.

These objects as well as other objects of the present invention will become more readily apparent from the following description in conjunction with the accompanying drawings.

DESCRIPTION OF THE PREFERRED EMBODIMENT

Figure 1:
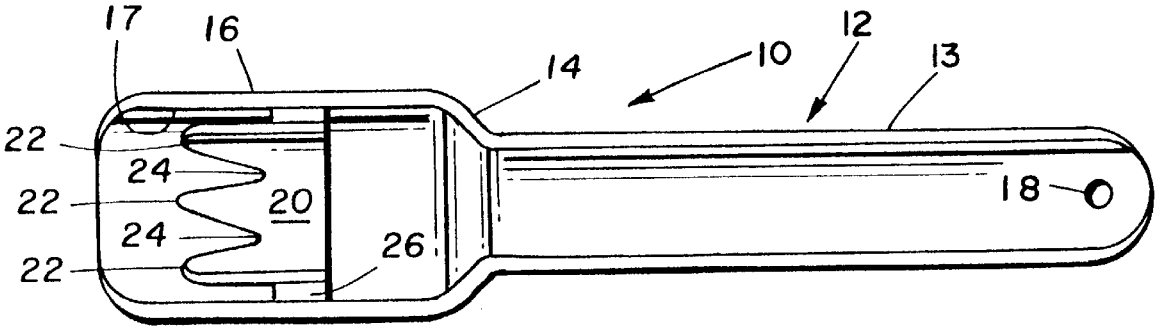
FIG. 1 is a bottom plan view of the paint rollers removal tool of the present invention.

Referring now more particularly to the drawings, the numeral 10 generally designates the paint roller removal tool of the present invention. Tool 10 can be made of any suitable material, but it has been found that prefabricated, rigid, molded pipe, commonly known as PVC, is a suitable material. Tool 10 has an integrally formed body consisting of a handle 12 and an enlarged C-shaped head 16. The handle 12 is generally elongate having a curved, generally hemispherical exterior surface, and opposite longitudinal edges 13. The forward end of handle 12 diverges to form an intermediate section 14 of tool 10 and to form enlarged C-shaped head 16. Enlarged C-shaped head 16 has opposite longitudinal edges (not numbered). A roller engaging member 20 having a plurality of teeth 22 separated by valleys 24 is secured to the inner surface 17 of C-shaped head 16 through a spacer element 26. While the roller engaging member 20 is shown as having teeth 22, it could be made such that it is a continuous shoulder instead of several teeth. While the spacer element 26 and roller engaging member 20 is shown as being two pieces, it could be made in a single piece. The spacer element 26 is secured to inner surface 17 of C-shaped head 16 and to the roller engaging member 20 by any suitable means such as an adhesive. An opening 18 is provided in handle 12 of tool 10 for hanging on a nail for storage purposes when the tool is not in use.

Figure 2:
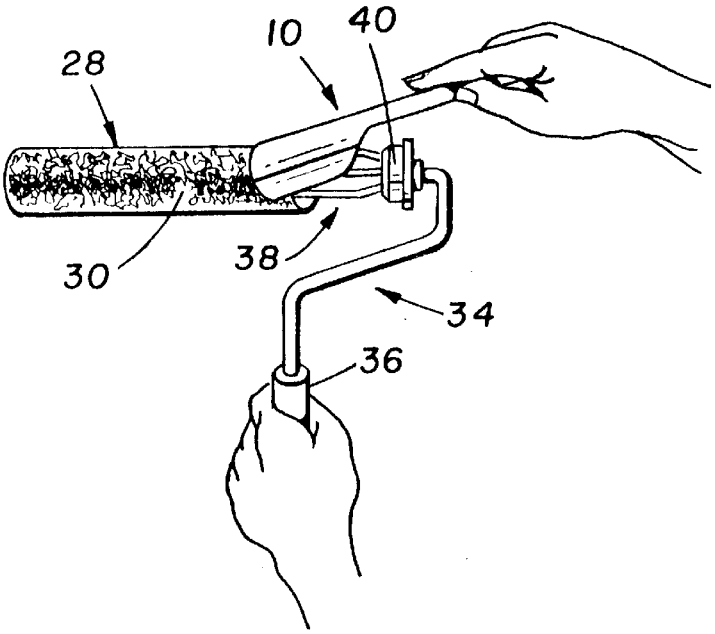
FIG. 2 is a pictorial plan view showing a user holding the paint roller removal tool in his right hand, a roller frame assembly in his left hand, and showing a used, paint soaked, roller partially removed from the roller frame assembly by the tool.
Figure 3:
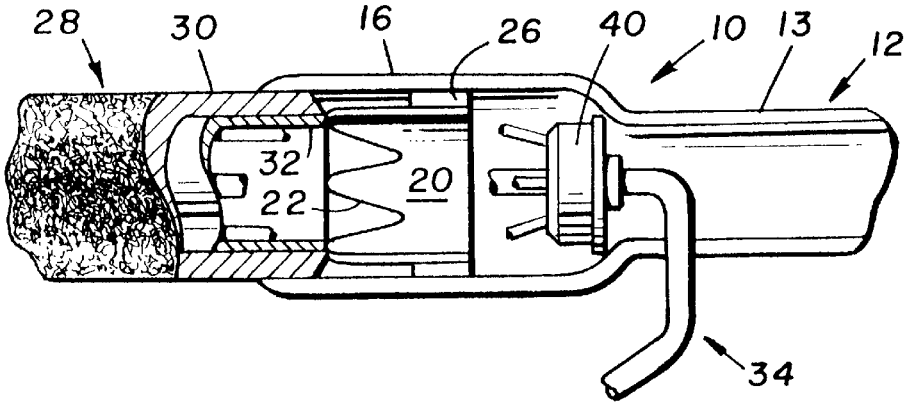
FIG. 3 is a sectional, partially broken away, view, of the tool of the present invention showing the tool in engagement with the core and roller for pushing or removing the roller from the roller frame assembly.

As best shown in FIGS. 2 and 3, the tool 10 of the present invention is used to remove a conventional paint soaked roller 28 having a fluffy nap 30 and core 32 from a conventional roller frame assembly 34. The conventional roller frame assembly 34 includes a handle 36, a wire frame 38 made up of a plurality of elongated wires (not numbered) connected at their ends to end caps 40, only one of the end caps 40 being shown in FIGS. 2 and 3.

In using the paint roller removing tool 10 of the present invention, a person will hold the roller frame assembly 34 in one hand and tool 10 in the other hand and place the semicylindrical inner surface 17 of head 16 of tool 10 over the end of roller 28 to cause the teeth 22 of roller engaging element 20 to engage either or both one end of core 32 and/or nap 30 of roller 28 and by pushing on the tool 10 to remove the paint soaked roller 28 from the cage or wire frame 38 of roller frame assembly 34. Once the roller 28 is removed from frame assembly 34, the roller 28 can be cleaned in any suitable manner and dried for future reuse. The roller engaging member 20 neither completely encompasses nor surrounds the used, paint soaked, roller 28 in the removal process.

In accordance with the foregoing, it will be seen that the present invention provides a unique hand held tool for removing used, paint soaked, rollers from conventional roller frame assemblies without the user having to touch the paint soaked roller.

It is obvious to those skilled in the art that although the invention has been described in a preferred embodiment, it will be appreciated that the invention is susceptible to modification, variation and change without departing from the proper scope and fair meaning of the accompanying claims.

I claim:

1. A hand-held tool for removing a used, paint soaked, roller from a paint roller frame assembly, said tool comprising:

a C-shaped head portion having an open inner surface;

a handle extending from said head portion; and roller engaging means secured to said open inner surface of said head portion and extending inwardly therefrom for engaging said used, paint soaked, roller adjacent an end thereof, whereby responsive to movement of said tool along said frame assembly said roller is pushed off said frame assembly.

2. The hand-held tool of claim 1 wherein said means secured to said inner surface of said head portion for engaging said used, paint soaked, roller comprises a generally C-shaped member having a roller engaging surface which engages an outer edge of said used, paint soaked, roller.

3. The hand-held tool of claim 2 wherein said generally C-shaped member has a plurality of teeth, each tooth of said plurality of teeth having said roller engaging surface disposed on the distal end thereof.

4. The hand-held tool of claim 3 wherein said means for engaging said used, paint soaked, roller further includes a spacer element between said inner surface of said head portion and said generally C-shaped member.

5. The hand-held tool of claim 4 wherein said handle has opposed longitudinal edges and an opening in one end to allow said tool to be hung for storage purposes.

6. In combination with a paint roller frame assembly including a paint roller having opposed ends removably secured to said paint roller frame assembly, a tool for removing said paint roller from said paint roller frame assembly comprising:

a C-shaped head portion having opposed longitudinal edges and a semicylindrical inner surface;

an elongated-handle extending from said C-shaped head portion;

an intermediate section which diverges from said handle for merging with said C-shaped head portion; and roller engaging means secured to said semicylindrical inner surface of said C-shaped head portion and extending inwardly therefrom for engaging said used, paint soaked, roller adjacent one end thereof, whereby responsive to movement of said tool along said frame assembly, said used, paint soaked, roller is pushed off said frame assembly.

7. The tool of claim 6 wherein said means for engaging said used, paint soaked, roller comprises a generally C-shaped member having a roller engaging surface which engages said one end of said roller.

8. The tool of claim 7 wherein said generally C-shaped member has a plurality of teeth, each said tooth of said plurality of teeth having said roller engaging surface disposed on the distal end thereof.

9. The tool of claim 8 wherein said means for engaging said used, paint soaked, roller further includes a spacer element between said semicylindrical inner surface of said generally C-shaped head portion and said generally C-shaped member.

10. The tool of claim 9 wherein said handle has an opening in one end to allow said tool to be hung for storage purposes.

* * * * *